US005086319A

United States Patent [19]

Carolan

[11] Patent Number: 5,086,319

[45] Date of Patent: Feb. 4, 1992

[54] MULTIPLE SERVO SYSTEM FOR COMPENSATION OF DOCUMENT MIS-REGISTRATION

[75] Inventor: Kevin M. Carolan, Rochester, N.Y.

[73] Assignee: Xerox Corporation, Stamford, Conn.

[21] Appl. No.: 437,708

[22] Filed: Nov. 17, 1989

[51] Int. Cl.[5] ..... G03G 21/00

[52] U.S. Cl. ..... 355/317; 271/265; 355/321

[58] Field of Search ..... 355/317, 321, 311, 309; 271/110, 111, 265, 259

[56] References Cited

U.S. PATENT DOCUMENTS

| | | | |
|---|---|---|---|
| 4,310,236 | 1/1982 | Connin | 355/317 |
| 4,416,534 | 11/1983 | Kluger | 355/317 |
| 4,455,018 | 6/1984 | Colglazier et al. | 355/317 X |
| 4,457,506 | 7/1984 | Ashbee et al. | 271/3.1 |
| 4,485,949 | 12/1984 | Gebhart et al. | 35/317 X |
| 4,519,700 | 5/1985 | Barker et al. | 355/317 X |
| 4,526,461 | 6/1985 | Eertink | 355/317 |
| 4,579,325 | 4/1986 | Pinckney et al. | 271/301 X |
| 4,579,444 | 4/1986 | Pinckney et al. | 355/317 |
| 4,581,566 | 4/1986 | Ekstrom et al. | 318/568 |
| 4,641,070 | 2/1987 | Pfizenmaier et al. | 318/640 |
| 4,696,564 | 9/1987 | Watanabe | 355/317 X |
| 4,705,386 | 11/1987 | Ogita et al. | 355/317 X |
| 4,755,855 | 7/1988 | Watanabe | 355/317 |
| 4,809,188 | 2/1989 | Willits et al. | 364/469 |
| 4,816,867 | 3/1989 | Ito | 355/14 SH |

FOREIGN PATENT DOCUMENTS 0176653 10/1983 Japan .

*Primary Examiner*—A. T. Grimley
*Assistant Examiner*—Nestor R. Ramirez
*Attorney, Agent, or Firm*—Duane C. Basch; Ronald F. Chapuran

[57] ABSTRACT

The present invention is a system for positioning an original document near a target registration point on an imaging platen of a xerographic reproduction system, including the capability to compensate for any resulting mis-registration of the document. The amount of mis-registration of the original document, in the feed direction, is determined by a servo encoder or positional sensing mechanism and passed to the control function of a subsequent servo-mechanical system. The subsequent servo-mechanical system controls the positional alignment of the copy paper with respect to the laten image present on the photoreceptor. This system automatically adjusts the nominal feed velocity of the copy paper to correct for the previously determined mis-registration of the latent image on the photoconductive surface. This, the positional error introduced by the document feeding system is removed at a subsequent subsystem within the xerographic system.

8 Claims, 6 Drawing Sheets

MULTIPLE SERVO SYSTEM FOR COMPENSATION OF DOCUMENT MIS-REGISTRATION

BACKGROUND OF THE INVENTION

1. Field of the Invention

This invention relates generally to the control of paper positioning within the document handling and development systems of a xerographic system and, in particular, to the compensation for the positional errors of such paper.

2. Description of the Prior Art

It is a generally known technique to utilize servo mechanisms to provide controlled movement within positioning systems. For example, U.S. Pat. No. 4,641,070 to Pfizenmaier et. al. discloses a device for determining and adjusting the position of a printing press web. The device comprises two sensor units, a control unit responsive to output signals from the two sensors, and a device connected to the control unit for adjusting the position of the web.

U.S. Pat. No. 4,809,188 to Willits et. al. discloses a strip feeding control system for positioning and registering patterned material. A material moving system uses a drive roller and an associated pressure roller in a pinch roll system to move the material. A motion detecting sensing device and optical sensor provide outputs to a computer which provides control of material movement and provides signals for initiating machining of pattern material when the pattern is properly located relative to a designated work station. The material moving mechanism comprises a servo drive motor, an encoder, and material control rollers.

The prior art also discloses means for correction of errors in movement within coordinate positioning systems. For example, U.S. Pat. No. 4,581,566 to Ekstrom et al. discloses a system for automatically calibrating a robot in all degrees of freedom to compensate for inaccuracies in different coordinate directions. This system determines by means of sensing means the actual position reached by a measuring body, calculates the errors in different coordinate directions based on the the measured values, and compensates for the errors in respective coordinate directions.

Furthermore, it is a generally known technique to utilize servo controlled mechanisms to move and register paper within a xerographic system. U.S. Pat. No. 4,457,506 to Ashbee et. al. discloses a servo controlled automatic document feeder having a plurality of independently driven document transport devices. Each transport device is independently driven by a motor and a closed-loop servo. A common reference oscillator generates source signals for the servo loops. A micro computer operates on the source signals and generates reference signals for driving the transport devices. U.S. Pat. No. 4,816,867 discloses an electrophotographic copy machine comprising a document supporting glass plate and timing rollers for feeding copying paper to which the image on the photoreceptor drum is transferred. The document supporting glass plate defines a reference position with respect to the scanning direction, whereby the timing rollers are controllable such that the image present on the photoreceptor drum is transferred to a central position of the copying paper with respect to a copying paper feed direction.

A deficiency with prior art systems is the requirement that the the document feeding servomechanisms operate at a relatively slow rate of speed or in a bidirectional manner to enable proper positioning of the original document on the platen for accurate imaging. This can add to the complexity and inefficiency of the document feeder. Furthermore, the inability to correct or compensate for positional error in a xerographic system demands that relatively accurate servomechanisms be used for positioning the components of the xerographic system. It would, thus, be desirable to be able to rapidly position an original document and determine the positional error of such a document, with respect to a registration position, for correction by a copy sheet feeding subsystem.

It is an object of the present invention, therefore, to automatically compensate for paper and document misregistration due to system inertia, slippage and other factors by quantifying the degree of positional error. It is another object of the present invention to provide a new and improved servo-mechanical control system capable of determining the positioning error introduced while feeding an original document to an imaging location and counteracting the positional error using a secondary servomechanism.

Further advantages of the present invention will become apparent as the following description proceeds and the features characterizing the invention will be pointed out with particularity in the claims annexed to and forming a part of this specification.

SUMMARY OF THE INVENTION

Briefly, the present invention is a system for compensating for the misregistration of a document on the platen of a xerographic system. The system is comprised of a servomechanism for positioning of an original document near a target registration point on an imaging platen. Subsequently, the positional error of the original document, in the feed direction, is determined by sufficient measurement means and passed to the control function of a subsequent servo-mechanical subsystem which controls the positional alignment of the copy sheet with respect to the latent image present on the photoreceptor. The subsystem automatically adjusts the velocity of the copy sheet to correct for the previously determined misregistration, thereby compensating for the positional error introduced by the document feeding subsystem.

BRIEF DESCRIPTION OF THE DRAWINGS

For a better understanding of the present invention, reference may be had to the accompanying drawings wherein the same reference numerals have been applied to like parts and wherein.

DESCRIPTION OF THE PREFERRED EMBODIMENT

Figure 1:
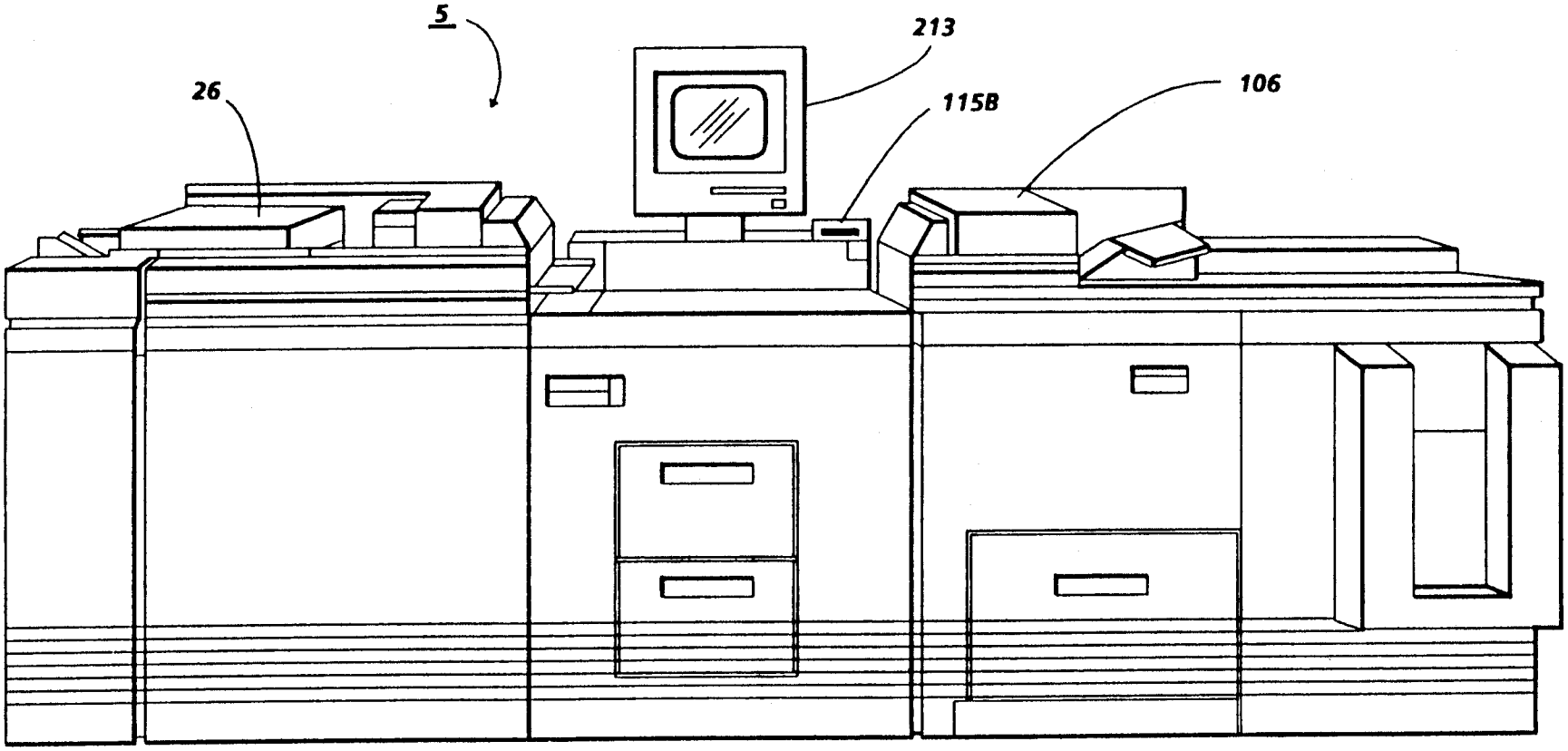
FIG. 1 is an isometric view of an illustrative xerographic reproduction machine incorporating the present invention.
Figure 2:
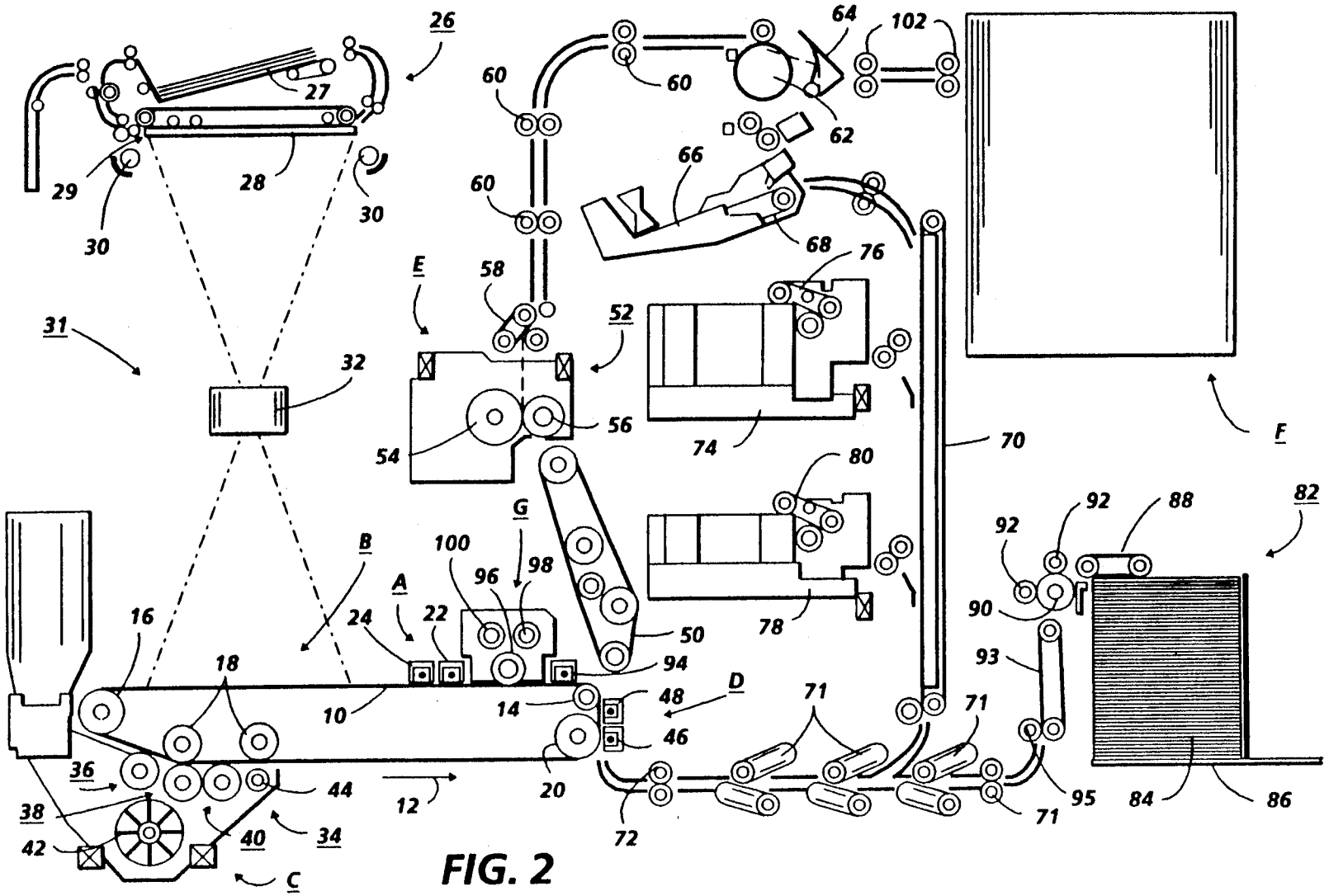
FIG. 2 is a schematic elevational view depicting various operating components and subsystems of the machine shown in FIG. 1.

For a general understanding of the features of the present invention, reference is made to the drawings. Referring to FIGS. 1 and 2, there is shown a typical xerographic reproduction machine 5 composed of a plurality of programmable components and subsystems which cooperate to carry out the copying or printing job programmed through a user interface (U.I.) 213.

Machine 5 employs a photoconductive belt 10. Belt 10 is entrained about stripper roller 14, tensioning roller 16, idler rollers 18, and drive roller 20. Drive roller 20 is rotated by a conventional motor or servomotor (not shown) coupled thereto by suitable means such as a belt drive. As roller 20 rotates it advances belt 10 in the direction of arrow 12 through the various processing stations disposed about the path of movement thereof.

Initially, the photoconductive surface of belt 10 passes through charging station A where corona generating devices, indicated generally by the reference numerals 22 and 24, charge photoconductive belt 10 to a relatively high, substantially uniform potential. Next, the charged photoconductive belt is advanced through imaging station B. At imaging station B, a document handling unit 26 sequentially feeds documents from a stack of documents in document tray 27 into registered position on platen 28. Xenon flash lamps 30 mounted in optics cavity 31 illuminate the document on platen 28, the light rays reflected from the document being focussed by lens 32 onto belt 10 to expose an electrostatic latent image on photoconductive belt 10 which corresponds to the informational areas contained within the document currently registered on platen 28. After imaging, the document is returned to document tray 27 via a simplex copy path or if the first pass of a duplex copy is being made via a duplex path.

The electrostatic latent image recorded on photoconductive belt 10 is developed at development station C by a magnetic brush developer unit 34 having developer roll assemblies 36, 38 and 40. A paddle wheel 42 picks up developer material and delivers it to the developer roll assemblies 36, 38. Developer roll assembly 40 is a cleanup roll while magnetic roll 44 is provided to remove any carrier granules adhering to belt 10.

Following development, the developed image is transferred at transfer station D to a copy sheet provided via de-skew rollers 71 and paper feed roller 72. There, the photoconductive belt 10 is exposed to a pretransfer light from a lamp (not shown) to reduce the attraction between photoconductive belt 10 and the toner powder image. Next, a corona generating device 46 charges the the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10.

Following transfer, a conveyor 50 advances the copy sheet bearing the transferred image to fusing station E where a fuser assembly, indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to gate 64 which guides the sheet to either finishing station F or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70, de-skew rollers 71 and paper feed rollers 72 for transfer of the second toner powder image to the opposed sides of the copy sheets. The duplex sheet is then fed through the same path as the simplex sheet to be advanced to finishing station F.

Copy sheets are supplied from a secondary tray 74 by sheet feeder 76 or from auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95, de-skew rollers 71 and paper feed rollers 72 move the sheet to transfer station D.

After transfer station D, photoconductive belt 10 passes beneath a corona generating device 94 which charges any residual toner particles remaining on belt 10 to a polarity conducive to their removal from photoconductive belt 10. Thereafter, a pre-charge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

Figure 3:
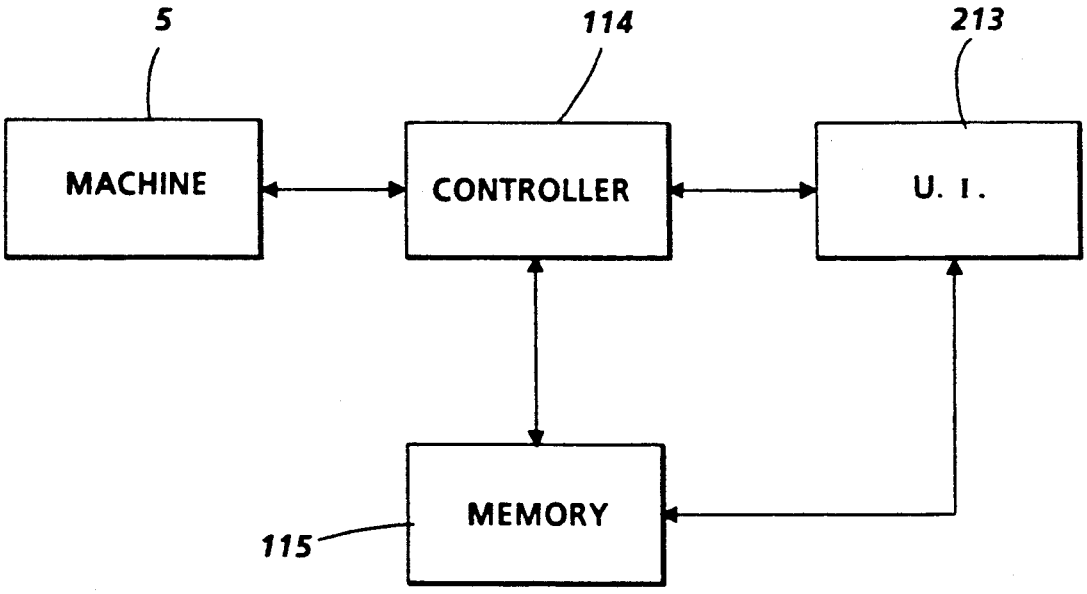
FIG. 3 is a general block diagram of the operating control systems and memory for the machine of FIG. 1.

With reference to FIG. 3, the various functions of machine 5 are regulated by a controller 114 which preferably comprises one or more programmable microprocessors. The controller provides a comparison count of the copy sheets, the number of documents being recirculated, the number of copies selected by the operator, time delays, and jam corrections. Programming and operating control over machine 5 is accomplished through U.I. 213. Operating and control information is stored in a suitable memory 115 and loaded into controller 114 through U.I. 213. Conventional sheet path sensors or switches, such as photocells or reed switches, may be utilized to keep track of the position of the documents and the copy sheets. In addition, the controller regulates the various positions of the mechanical gates, used to control document and paper travel, depending upon the mode of operation selected.

Figure 4:
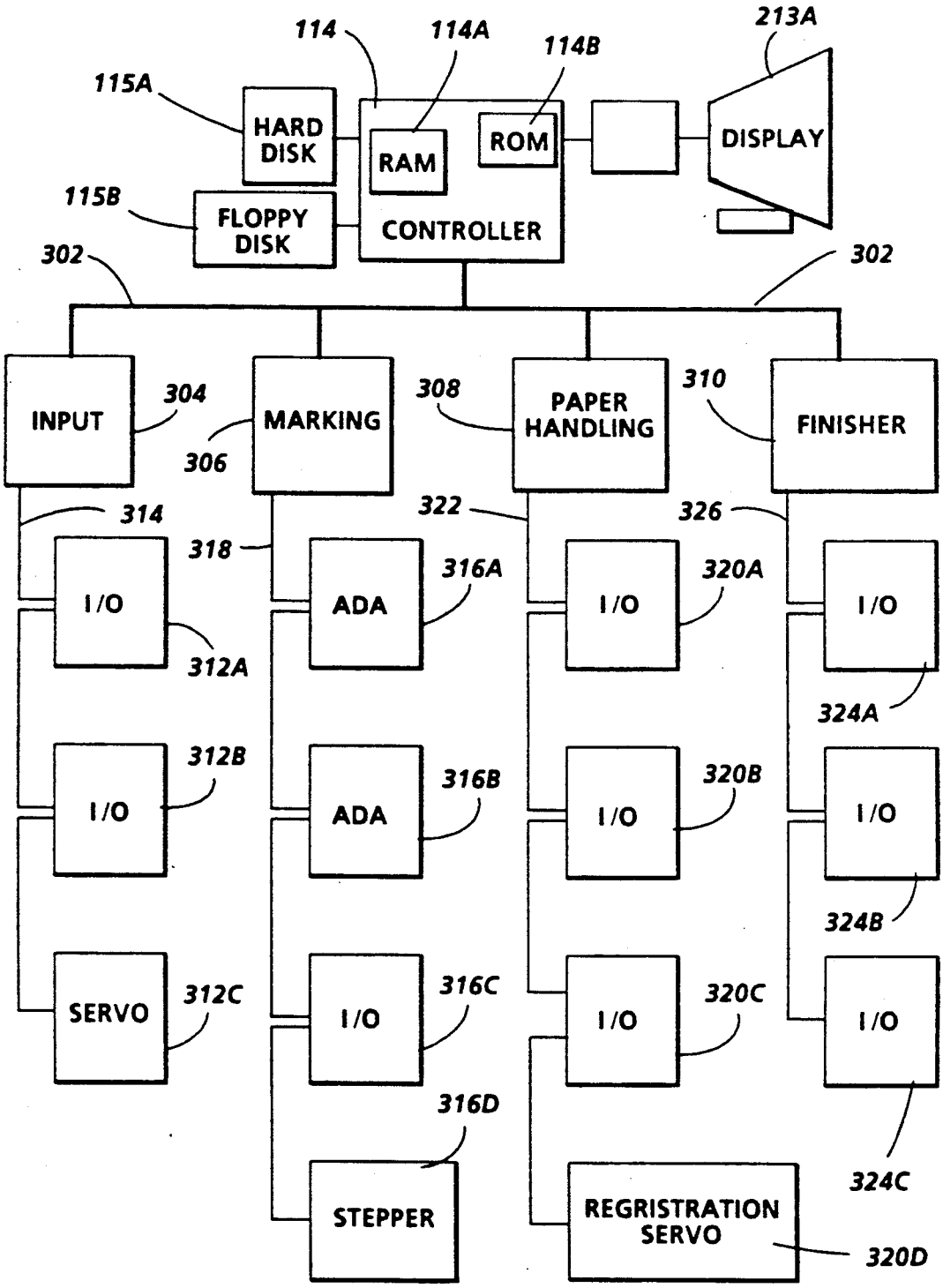
FIG. 4 is a more detailed block diagram of the control of FIG. 3.

With reference to FIGS. 3 and 4, memory 115 includes a hard or rigid disk drive 115A for receiving suitable rigid memory disks and a floppy disk drive 115B for receiving suitable floppy memory disks, both disk drives being electrically connected to Controller 114, the Controller 114 including RAM 114A and ROM 114B. In a preferred embodiment, the rigid disks are two platter, four head disks with a formatted storage capacity of approximately 20 megabytes. The floppy disks are 3.5 inch, dual sided micro disks with a formatted storage capacity of approximately 720 kilobytes. In normal machine operation, all of the control code and screen display information for the machine is loaded from the rigid disk at machine power up. Changing the data that gets loaded into the machine for execution can be done by exchanging the rigid disk in the machine 5 for another rigid disk with a different version of data. In accordance with the present invention, however, all of the control code and screen display information for the machine can be loaded from a floppy disk at machine power up using the floppy disk drive built into the machine 5. Suitable display 213A of U.I 213 is also connected to Controller 114 as well as a shared line system bus 302.

The shared line system bus 302 interconnects a plurality of core printed wiring boards including an input station board 304, a marking imaging board 306, a paper handling board 308, and a finisher/binder board 310. Each of the core printed wiring boards is connected to local input/output devices through a local bus. For example, the input station board 304 is connected to digital input/output boards 312A and 312B and servo board 312C via local bus 314. The marking imaging board 306 is connected to analog/digital/analog boards 316A, 316B, digital input/output board 316C, and stepper control board 316D through local bus 318. In a similar manner, the paper handling board 308 connects digital input/output boards 320A, B, C and D to local bus 322, and finisher/binder board 310 connects digital input/output boards 324A, B and C to local bus 326.

Figure 5:
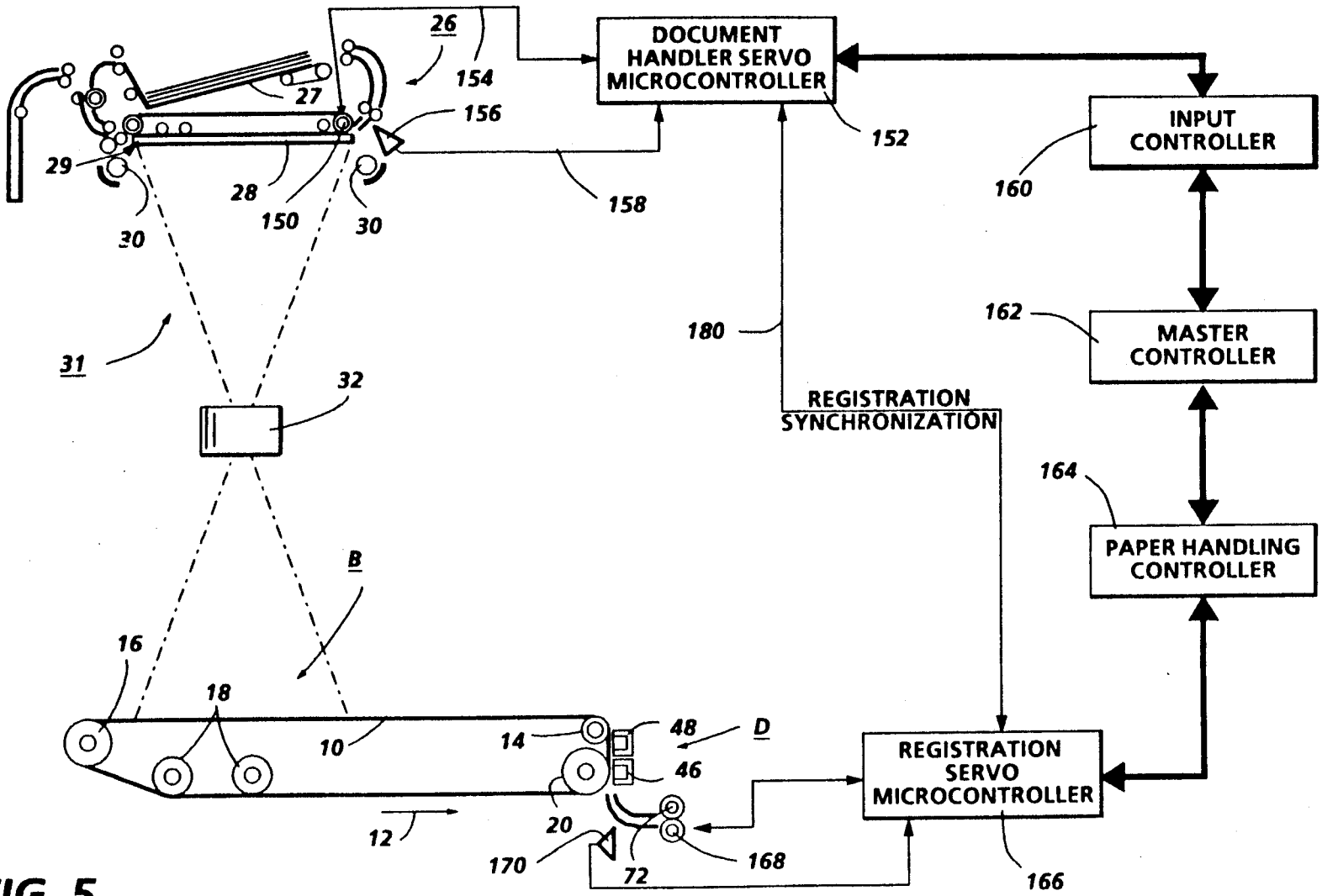
FIG. 5 is a block diagram of the operating control systems which incorporate the present invention.

With reference to FIG. 5, the multiple servo registration system in accordance with the present invention includes a document handler 26 with a platen feed roll 150. Platen feed roll 150, rotated by a motor (not shown) and controlled by document handler servo microcontroller 152 via wiring harness 154, is used to drive the platen feed belt and an adjoining document across the surface of platen 28. The platen feed roll 150 is coupled to the motor by suitable means, such as a drive belt.

Rotation of platen feed roll 150 is initiated by document handler servo microcontroller 152 via communications from the input station board 304. At such a time when sensor 156 is activated by the presence of a document, a signal is passed to microcontroller 152 over line 158. The signal indicates the presence of the leading edge of the document. Subsequent to detecting the signal from sensor 156, microcontroller 152 monitors the pulses output from the servomotor (not shown) driving platen feed roll 150.

When microcontroller 152 detects a nominal number of pulses sufficient to cause the document to reach a registration point on platen 28, the servomotor driving platen feed roll 150 will be turned off. Inherent in this system is the potential for mis-registration. Therefore, the servo-mechanical system that controls platen feed roll 150 is used as a means for the determination of the document position on platen 28, via the encoder pulses fed back over harness 154 to microcontroller 152, to allow subsequent compensation for the mis-registration.

As an alternative to a servo-mechanical determination of document position on platen 28, a sensor array may be used to sense the lead edge of the document as it approaches registration position 29, in close proximity to the end of platen 28. Document handler servo microcontroller 152 feeds the document position information back to input controller 160 for determination of the registration error of the document.

The registration error value is determined by computing the variance between a nominal or intended advancement of platen feed roll 150 and the actual advancement of the document feed roll as fed back from document handler servo microcontroller 152. Specifically, a negative registration error value would indicate that the document did not reach the nominal registration position on platen 28 and the resultant electrostatic latent image on photoconductive belt 10 will be shifted ahead of the nominal processing position. A positive shift of the electrostatic latent image on photoconductive belt 10 would require a compensating positive shift in the copy sheet position at transfer station D to maintain congruity between the copy and the original document. Correspondingly, a positive registration error value, caused by travel beyond the registration point, would require a negative compensation in copy sheet position at transfer station D.

The registration error value, as determined from the positional variance of the document, is relayed to paper handling controller 164. The registration error discussed above would normally result in a mis-synchronization of the copy sheet at transfer station D, the copy sheet being conveyed from tray 86 to the transfer station via transports 93, idler rolls 59, de-skew rollers 71 and paper feed rollers 72.

Specifically, the registration error value, in accordance with the present invention, is utilized by registration servo microcontroller 166 to adjust a present velocity profile for feed rollers 72 as controlled by copy sheet servo 168, thereby altering the location on photoconductive belt 10 that is intersected by the lead edge of the copy sheet. By so adjusting the velocity of the copy sheet, the positional deviation of the latent image on photoreceptor 10 can be compensated for as the copy sheet advances to transfer station D.

The adjusted velocity profile implemented by registration servo microcontroller 166 is initiated when sensor 170 signals microcontroller 166 that the lead edge of the copy sheet has been detected. Feed rollers 72 are rotated by a motor, controlled by registration servo microcontroller 166 via wiring harness 168, coupled thereto by suitable means, such as a drive belt.

Figure 6A:
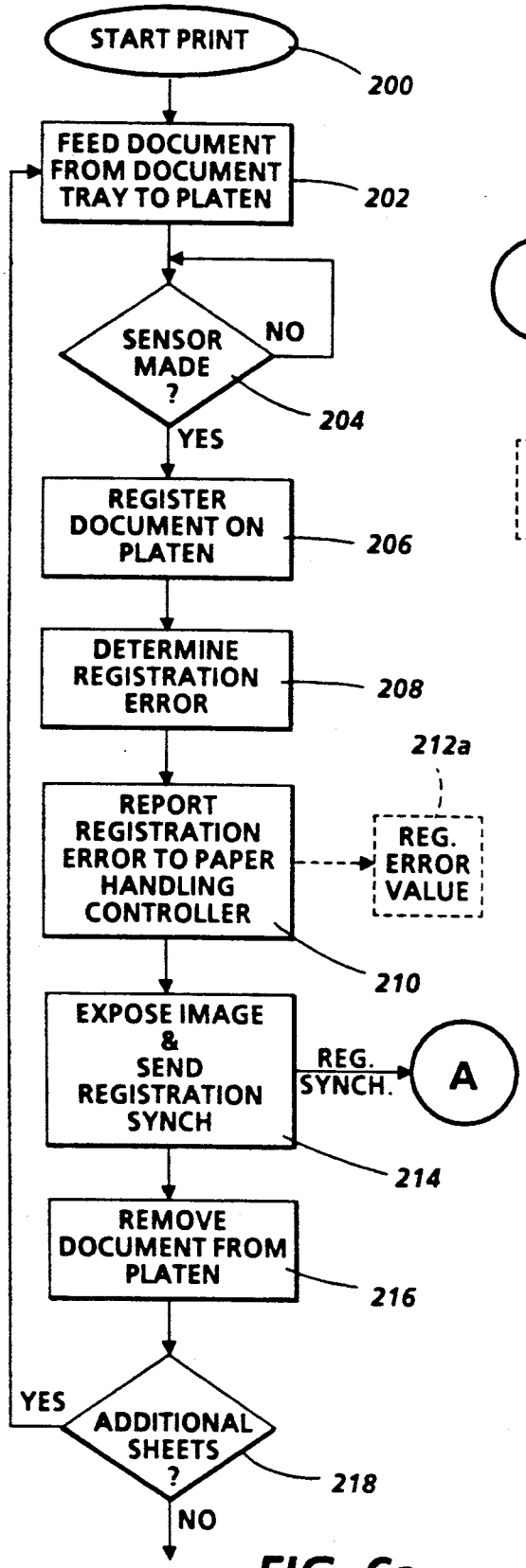
FIGS. 6*a* and 6*b* illustrate a flow chart of the multiple servo registration control system in accordance with the present invention.
Figure 6B:
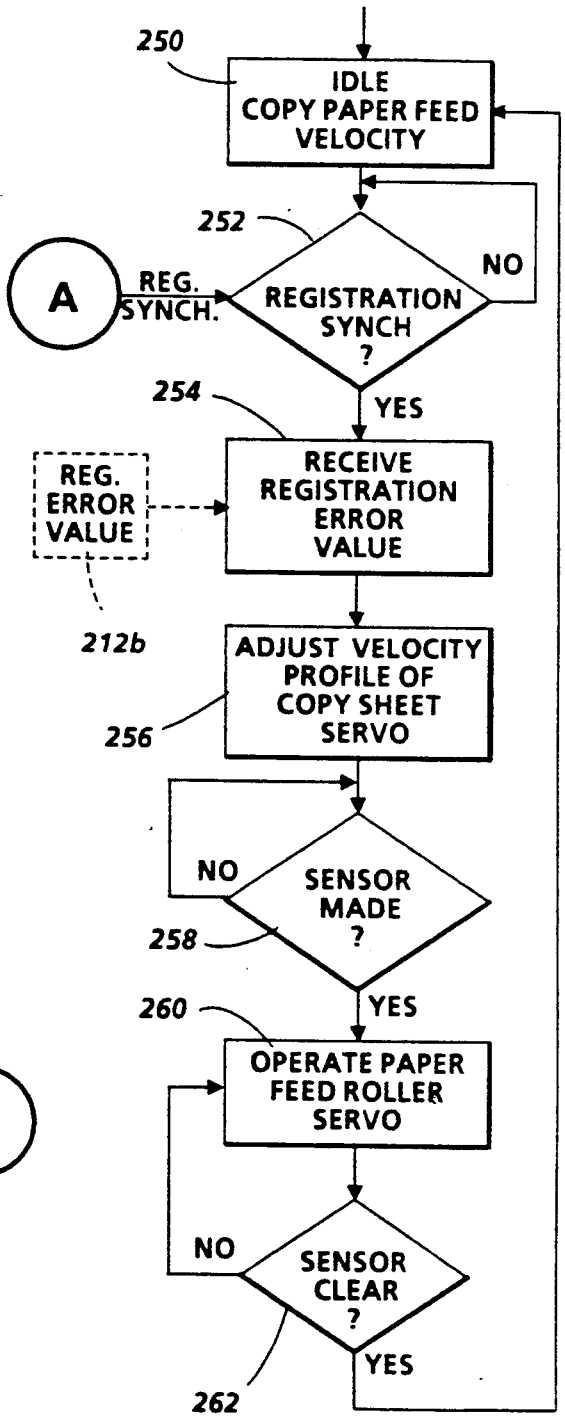

With reference to FIGS. 5, **6*a* and 6*b*, wherein FIG. 6*a* represents the control algorithm for the document handler servo microcontroller 152 and FIG. 6*b* represents the control algorithm for the registration servo microcontroller 166. At start print 200, an original document is fed from the document tray of document handler 26 to platen 28, indicated by block 202. Traveling past sensor 156, the document triggers sensor test block 204** and establishes the lead edge of the document.

Registration of the document on the platen, block 206, is accomplished via the servomechanism which controls platen feed roll 150. Microcontroller 152 directs the servomotor connected to platen feed roll 150 to advance the document until a nominal number of encoder pulses, as fed back from the servomotor, have been detected the microcontroller. Ideally, the nominal number of encoder pulses is appropriate to allow the advancement of the original document to a registration point on the platen.

Uncontrollable factors, for instance system friction or system inertia, may cause an over- or under-travel situation, resulting in misregistration of the original document on platen 28. However, the actual travel distance, as determined from the number of encoder pulses fed back to the document handler servo microcontroller 152, can be compared to to nominal number of pulses, as programmed, to determine the registration error in block 208. The registration error 212*a* is then communicated to the registration servo microcontroller 166 for adjustment of the copy sheet position, as indicated by block 210.

The document handler servo microcontroller 152 will then simultaneously trigger the exposure of the original document on platen 28 and send a registration synchronization signal, via line 180, to the registration servo microcontroller 166 to signal that an electrostatic latent image is now on photoconductive belt 10, as illustrated in block 214. A subsequent document removal operation, block 216, will remove the document from the platen. Finally, if additional sheets are present in the document tray, the process will repeat beginning at block 202.

Coincident with the operation of the document handler servo microcontroller 152, the registration servo microcontroller 166 is executing the algorithm illustrated in FIG. 6*b*. In the idle state, illustrated by block 250, paper feed roller 72 operates at a nominal velocity capable of accepting a copy sheet from idler roll 95 of FIG. 2.

When the registration synchronization signal from the document handler servo microcontroller 152 is received on line 180, a copy sheet will be fed towards transfer station D via idler roll 95, de-skew rollers 71 and paper feed rollers 72. Shortly thereafter, registration servo microcontroller 166 will receive the registration error value, block 254, as relayed from document handler servo microcontroller 152 via input controller 160, master controller 162, and paper handling controller 164.

The registration error value 212*b* received by registration servo microcontroller 166 will be used to adjust the velocity profile of the copy sheet feed servo 256. When the copy sheet reaches sensor 170, illustrated by block 258, the velocity of paper feed roll 72 will be adjusted to synchronize the speeds of the copy sheet and photoconductive belt 10 and to register the lead edge of the copy sheet with the leading edge of the electrostatic latent image contained on photoconductive belt 10. This is accomplished in block 260 by operating the paper feed roll servomotor according to the adjusted velocity profile.

When the copy sheet has reached a velocity that is synchronized to the velocity of the photoconductive belt 10, the paper feed servo will maintain that velocity until such a time as the copy sheet has cleared sensor 170, as indicated by block 262. At that time the registration servo microcontroller will cause the paper feed roll to ramp up in speed to once again match the speed of incoming copy sheets fed from idler roll 95 of FIG. 2. Thus, completing the control algorithm and returning to block 250 to continue the cycle for subsequent exposures.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

I claim:

1. A reproduction system, comprising:

an imaging station having a support for documents to be reproduced, a document drive disposed near said imaging station to convey a document to said imaging station, at a predetermined document registration position, means for stopping the document at a point near said document registration position, means, located at the imaging station, for providing an indication of the variance of the actual position of the stopped document from the predetermined document registration position, a photosensitive member for receiving an image of the document from the imaging station, a source of image receiving members, said source being disposed near said photosensitive member, a transport located adjacent said source of image receiving members to convey an image receiving member in a continuous fashion to the photosensitive member for the transfer of an image of the document to the image receiving member, a transport drive connected to the transport to control the movement of the transport, and a drive controller connected to the transport drive to control the velocity of the image receiving members in response to the indication of the variance provided by said variance indicating means located at the imaging station.

2. The system of claim 1 wherein said drive controller further includes control means, responsive to the variance indication, for adjusting the velocity of the transport drive in order to move the image receiving member to the photosensitive member and to synchronize the transfer of the image of the document to the image receiving member.

3. A reproduction system, comprising:

a support for documents to be reproduced, a document drive disposed near the support to convey a document to an imaging station, the imaging station having a predetermined document registration position, means, sensitive to the document velocity, for providing an indication of the variance of the actual document registration position from the predetermined document registration position upon determining that the document is stationary, a photosensitive member for receiving an image of the document from the imaging station, a source of image receiving members, the source being disposed near the photosensitive member, a transport located adjacent to the source of image receiving members to convey an image receiving member in a continuous fashion to the photosensitive member for the transfer of an image of the document to the receiving member, a transport drive connected to the transport to control the movement of the transport, and a drive control connected to the transport drive to control the transport of the image receiving members, the drive control being responsive to the indication of the variance and thereby altering the speed of movement of the image receiving member with respect to the photosensitive member, so that the image receiving member is synchronized with the image on the photosensitive member.

4. A system for compensating for the mispositioning of a stationary document, by a document drive, on a platen, the document being imaged onto a photosensitive member and the image being transferred to a copy sheet, comprising:

sensing means, disposed near the platen, for sensing the position of the document on the platen, means, responsive to said sensing means, for determining the variance in the position of the document from a registration position, a source of copy sheets, a copy sheet drive disposed near the source of copy sheets to convey a copy sheet from the source of copy sheets to the photosensitive member in a continuous motion for transfer of the image to the copy sheet, and means, responsive to the variance of the actual document position from the registration position, for adjusting the copy sheet drive to compensate for said variance while conveying the copy sheet to the photosensitive member.

5. The system of claim 4 wherein said adjusting means includes a servo mechanism to alter the time of arrival of the copy sheet at the photosensitive member.

6. The system of claim 5 wherein the servo mechanism synchronizes the time of arrival of the copy sheet with the image on the photosensitive member.

7. The system of claim 5 wherein the servo mechanism alters the speed of movement of the copy sheet in response to said variance of the position of the document on the platen.

8. The system of claim 4 wherein the sensing means is a feedback signal from the document drive.

* * * * *